United States Patent [19]

Johnson

[11] 3,934,724

[45] Jan. 27, 1976

[54] NEST AND STACK CONTAINER

[75] Inventor: Lewis T. Johnson, Bartlesville, Okla.

[73] Assignee: Phillips Petroleum Company, Bartlesville, Okla.

[22] Filed: Jan. 17, 1974

[21] Appl. No.: 434,094

[52] U.S. Cl. ..... 206/507

[51] Int. Cl.[2] ..... B65D 21/04

[58] Field of Search ..... 206/505, 506, 507, 515, 206/518, 519, 520, 503

[56] References Cited

UNITED STATES PATENTS

| | | | |
|---|---|---|---|
| 3,319,799 | 5/1967 | Paxton | 206/507 |
| 3,380,625 | 4/1968 | Kreeger | 206/507 |
| 3,392,877 | 7/1968 | Sanders | 206/507 |
| 3,420,402 | 1/1969 | Frater | 206/507 |
| 3,825,114 | 7/1974 | Johnson et al. | 206/507 |

*Primary Examiner*—George E. Lowrance

[57] ABSTRACT

A nest and stack container adapted to nest in, or stack on, a lower container of like construction, depending upon the orientation of the upper container with respect to said lower container. The walls of the container comprise bar members which extend between the bottom and an upper guide rail of the container. Said bar members are arranged such that the bar members of an upper container parallel the bar members of a lower container during nesting. Said guide rails on opposite ends or sides of the container make possible "blind stacking" or "blind nesting" of the containers, even at heights greater than the height of the person stacking or nesting the containers.

25 Claims, 16 Drawing Figures

NEST AND STACK CONTAINER

This invention relates to a nest and stack container.

Nest and stack containers, e.g., containers so constructed that an upper container will nest within, or stack on, a like lower container, depending upon the container structure and the orientation of the upper container with respect to the lower container, are known in the art. It is common for such prior art containers to be provided with stacking means so constructed, and/or so located, as to require rather precise registering or engagement between the stacking feet on the upper container and the corresponding stacking saddles on the lower container.

Said precise registering or engagement has, at least in many instances, created problems in stacking and has lessened the utility of such containers. For example, said required precise registering of the stacking means slows the stacking operation. Another difficulty which is commonly encountered with most prior art containers is that said required precise registering of the stacking means makes it necessary for the operator stacking the containers to visually observe the stacking means during the stacking operation. This limits the height to which an operator can ordinarily stack the containers without making special provisions. For example, when the height of a stack of stacked or nested containers approaches or is greater than eye level, the operator must start a new stack or else employ a ladder.

The present invention solves the above problems by providing a container having stacking feet adjacent the bottom of the container and stacking saddles adjacent the top of the container which do not require the precise registering therebetween during stacking operations which is required of most of the prior art containers. In stacked position the stacking feet adjacent the bottom of an upper container of the invention engage the stacking saddles adjacent the top of a lower container of the invention over a relatively broad are. Furthermore, the containers of the invention are provided with guide means and guide rails, which cooperate to facilitate "blind stacking" and "blind nesting". An operator stacking or nesting the containers of the invention can stack or nest same essentially as high as he can reach without having to visually observe and precisely register the stacking means on the containers.

Thus, according to the invention, there is provided a generally rectangular nesting and stacking container, comprising: a generally horizontally disposed bottom; first and second guide means projecting outwardly from opposing first and second sides of said bottom, respectively; first and second wall structures respectively projecting upwardly from said first and second sides of said bottom, said wall structures respectively comprising first and second guide rails disposed generally vertically above said first and second sides of said bottom and adapted to coact with said first and second guide means during pre-nesting and pre-stacking operations and provided with clearway means therein for accommodating said guide means during nesting and stacking operations; first and second pluralities of stacking feet respectively disposed at spaced apart locations on said first and second sides of said bottom; and first and second pluralities of stacking saddles respectively disposed at spaced apart locations on the inner wall surfaces of said first and second guide rails, and adapted to coact with said stacking feet and support an upper said container on a like lower container in stacked relationship.

Figure 4:
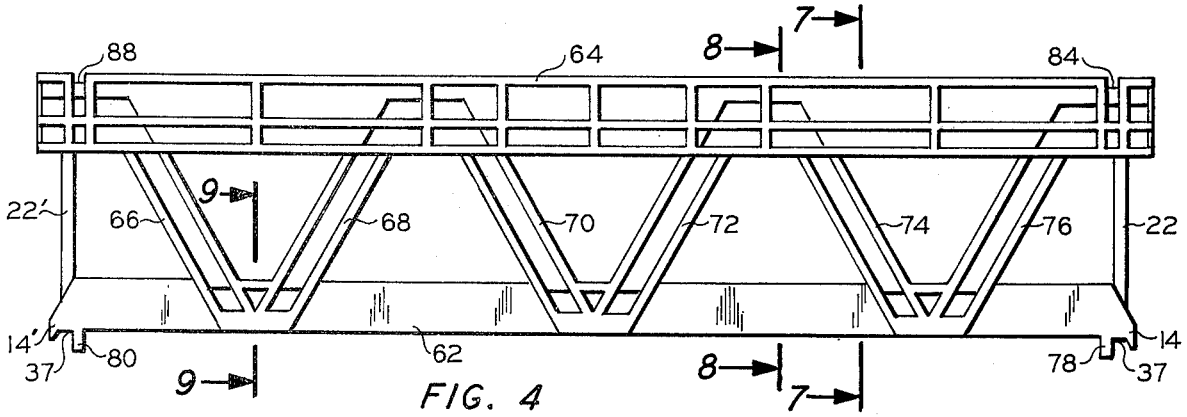
FIG. 4 is a side elevation view of one side of the container of FIGS. 1 and 2.
Figure 9:
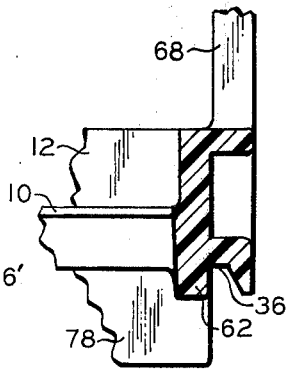
Figure 8:
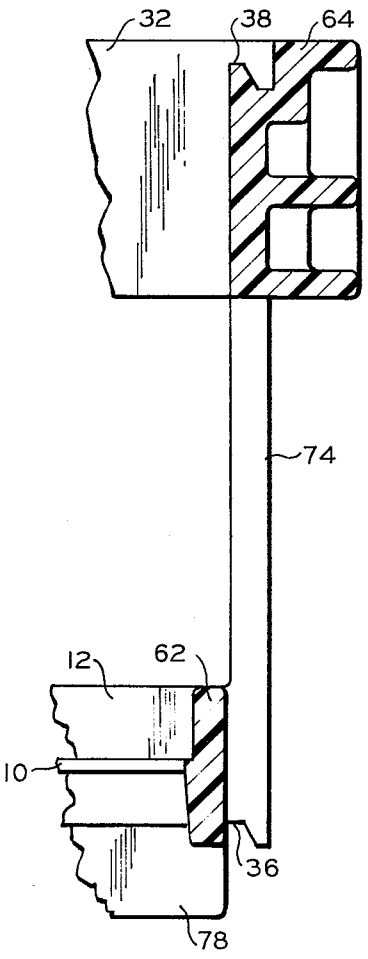
Figure 7:
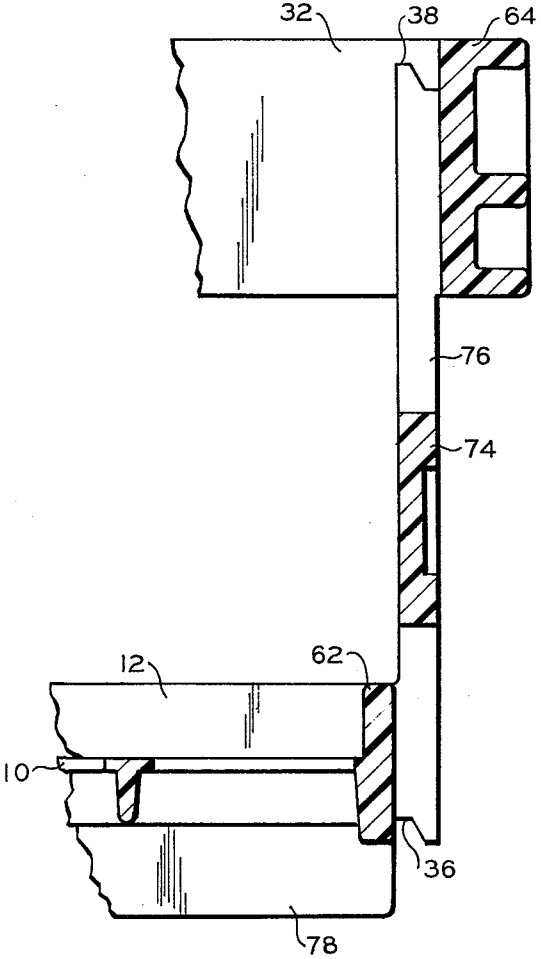
Figure 6:
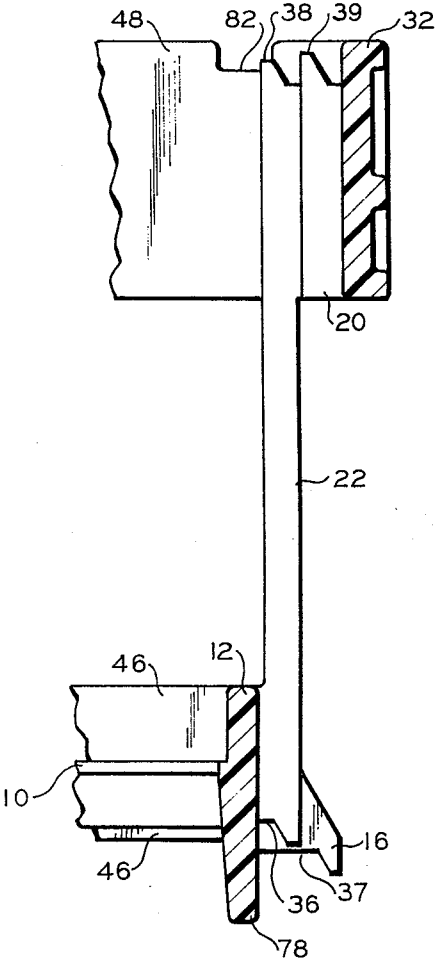
FIG. 6 is a cross section view taken along the line 6—6 of FIG. 3.

FIGS. 7, 8, and 9 are cross section views taken along the lines 7—7, 8—8, and 9—9, respectively, of FIG. 4.

Figure 5:
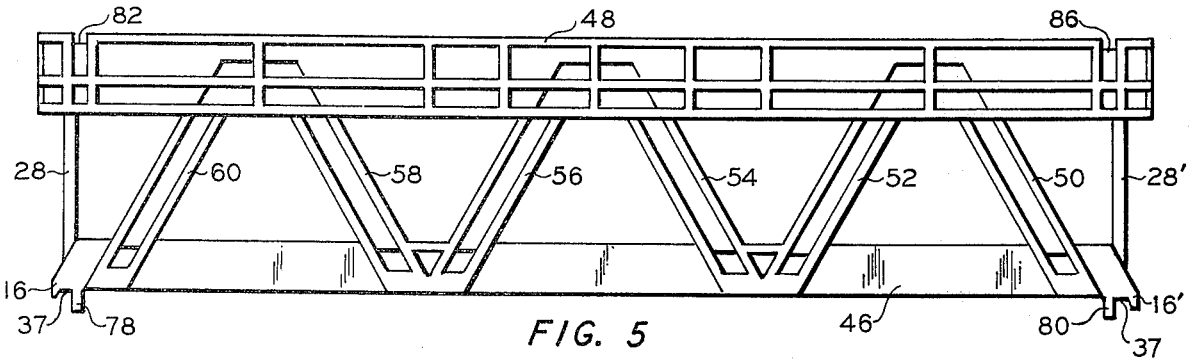
FIG. 5 is a side elevation view of the other side of the container of FIGS. 1 and 2.
Figure 10:
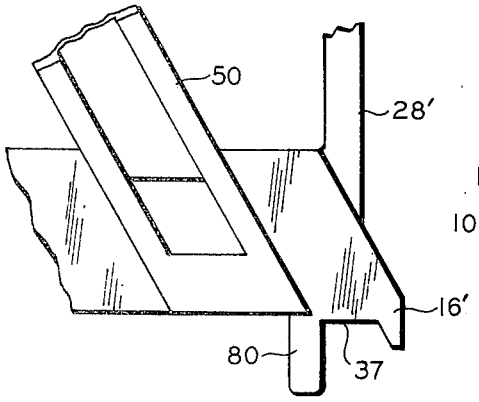

FIG. 10 is an enlarged detail view of the lower right corner of FIG. 5.

Figure 11:
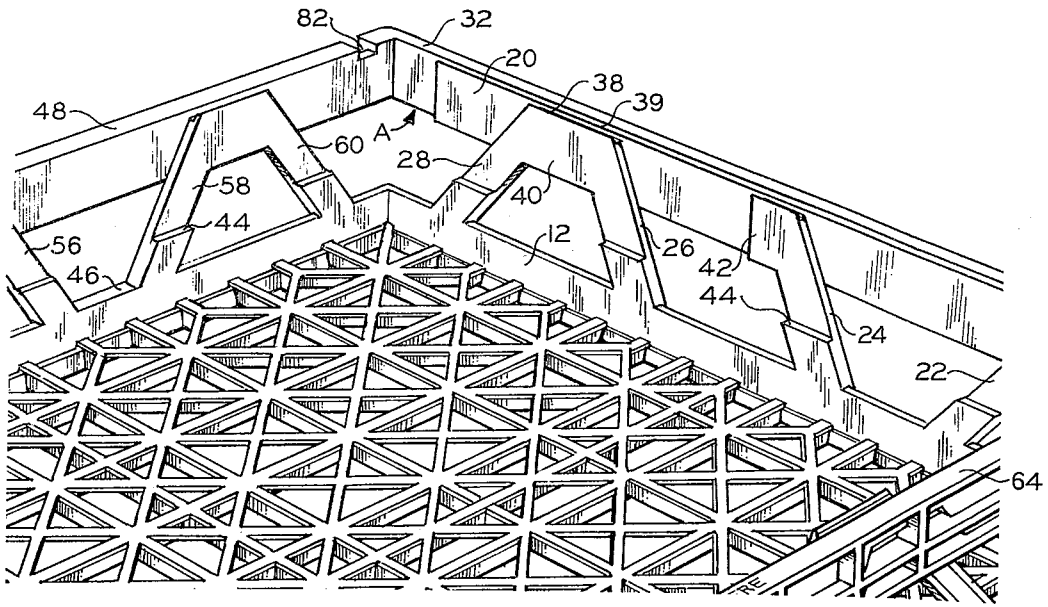

FIG. 11 is a partial perspective view of another container of the invention.

Figure 12:
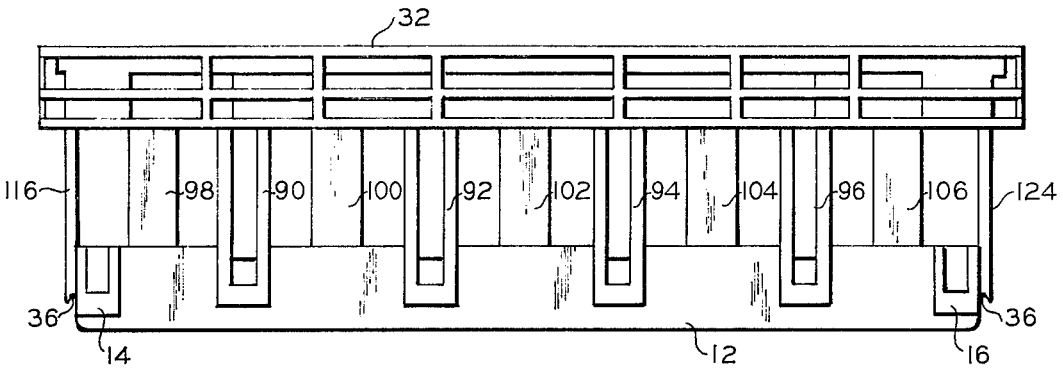

FIG. 12 is an end elevation view looking through another container of the invention.

Figure 13:
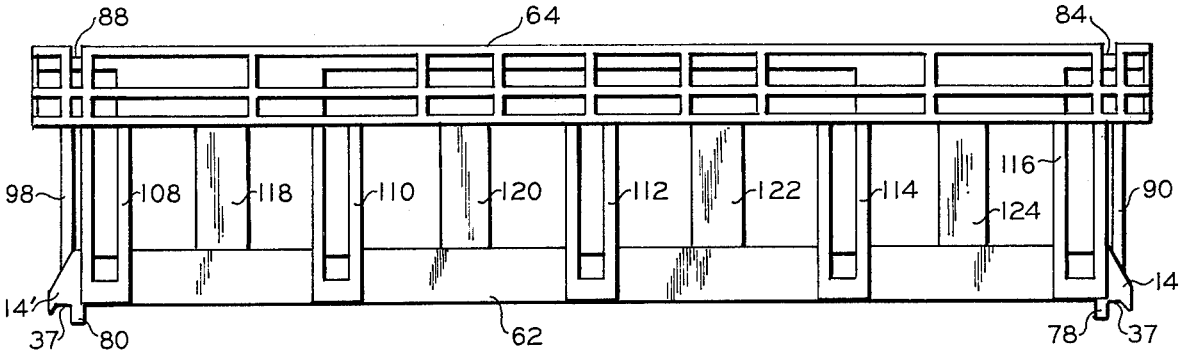

FIG. 13 is a side elevation view looking through the container of FIG. 12.

Figure 14:
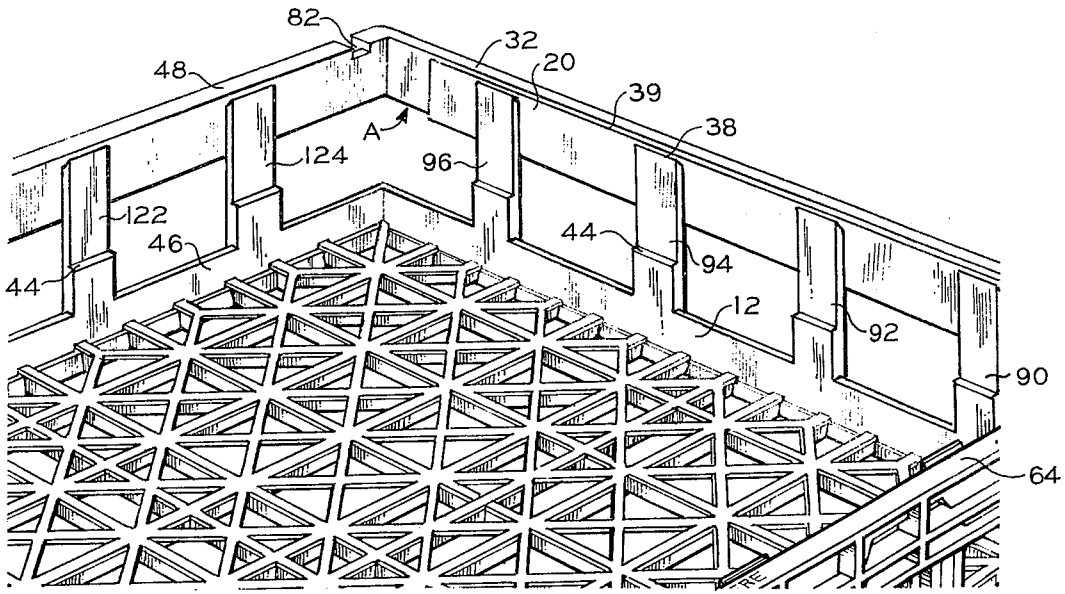

FIG. 14 is a partial perspective view of another container of the invention, similar to the container of FIGS. 12 and 13.

Figure 1:
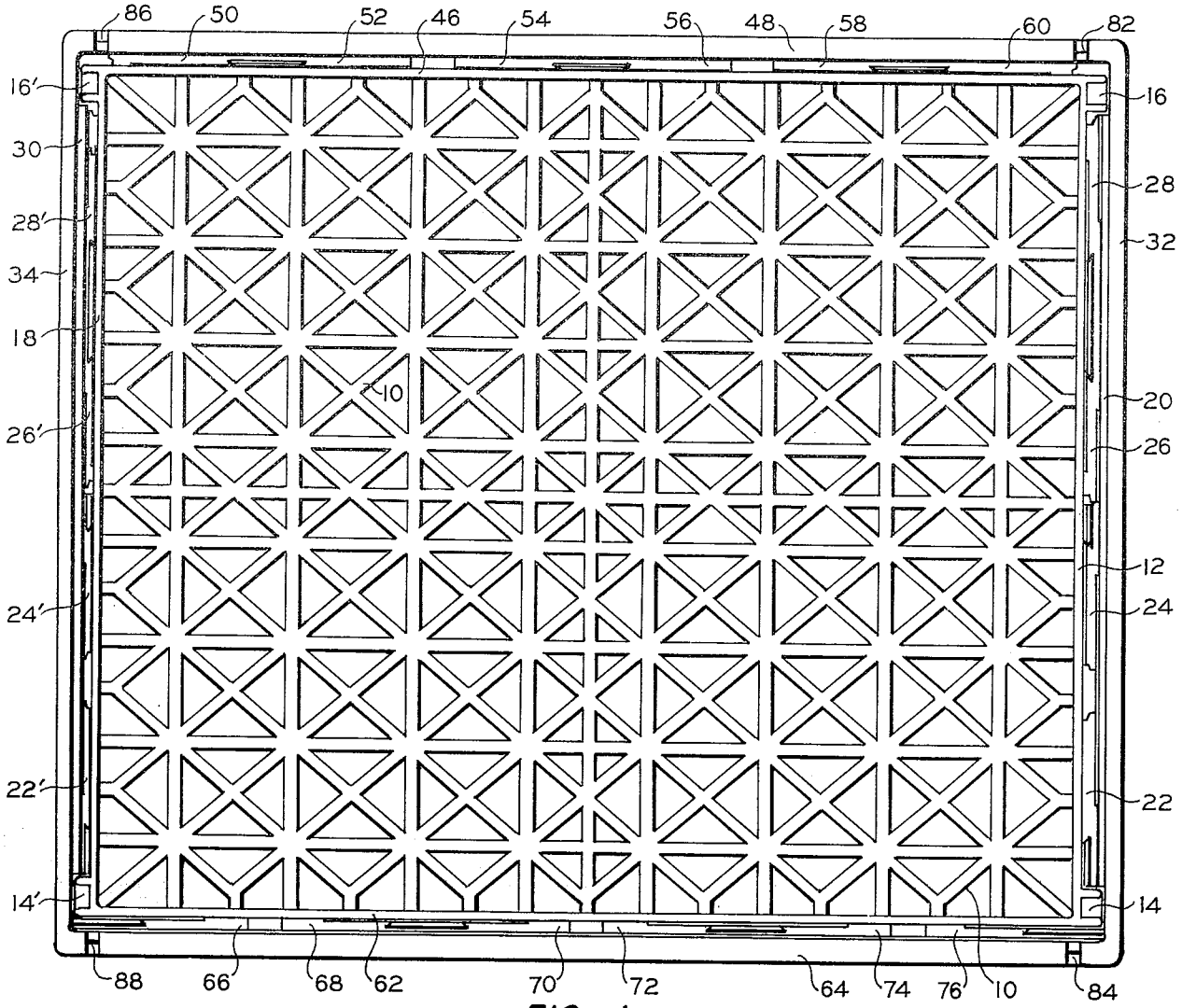
FIG. 1 is a top plan view of one presently preferred container of the invention.
Figure 2:
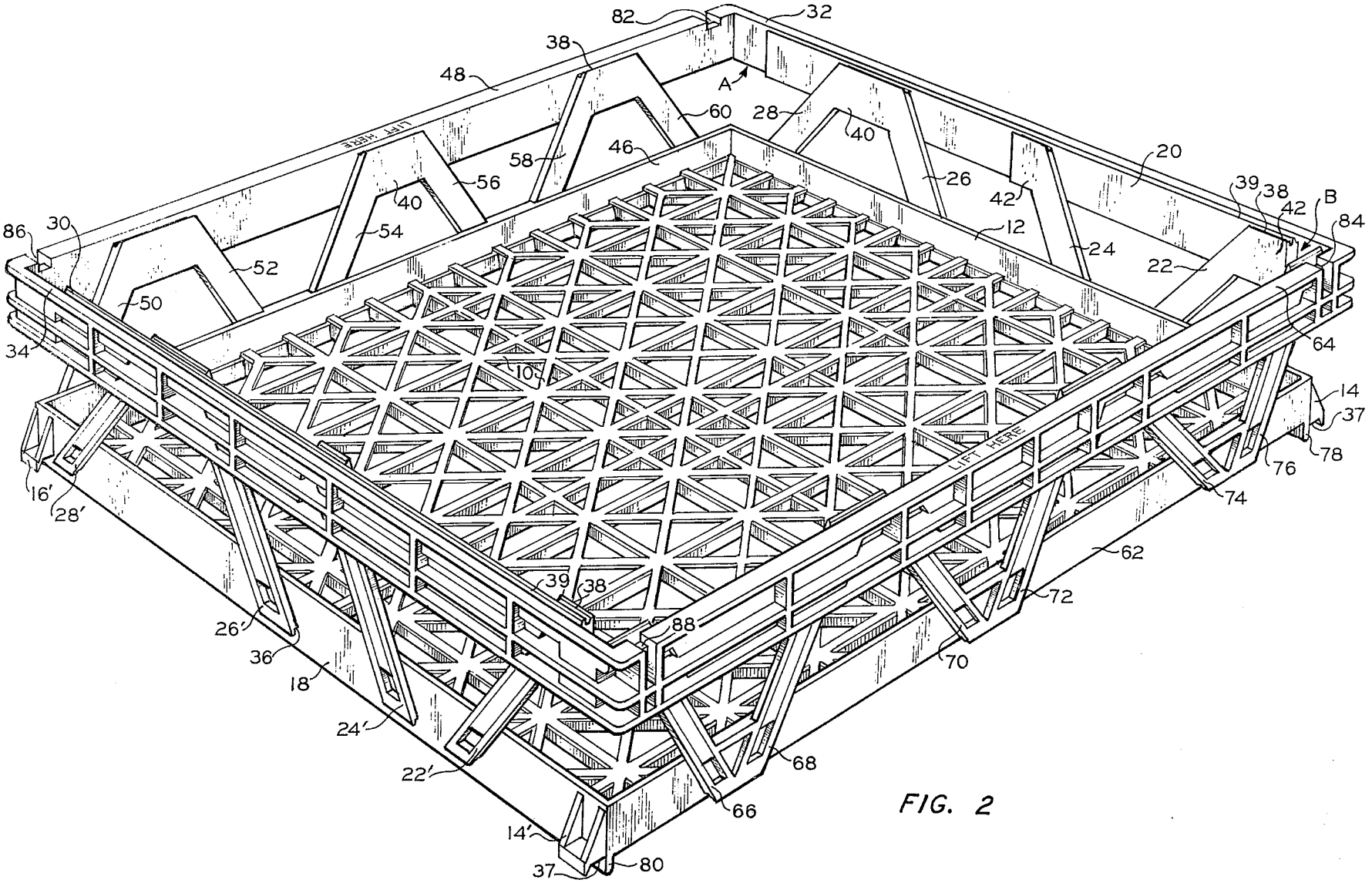
FIG. 2 is a perspective view of the container of FIG. 1.
Figure 15:
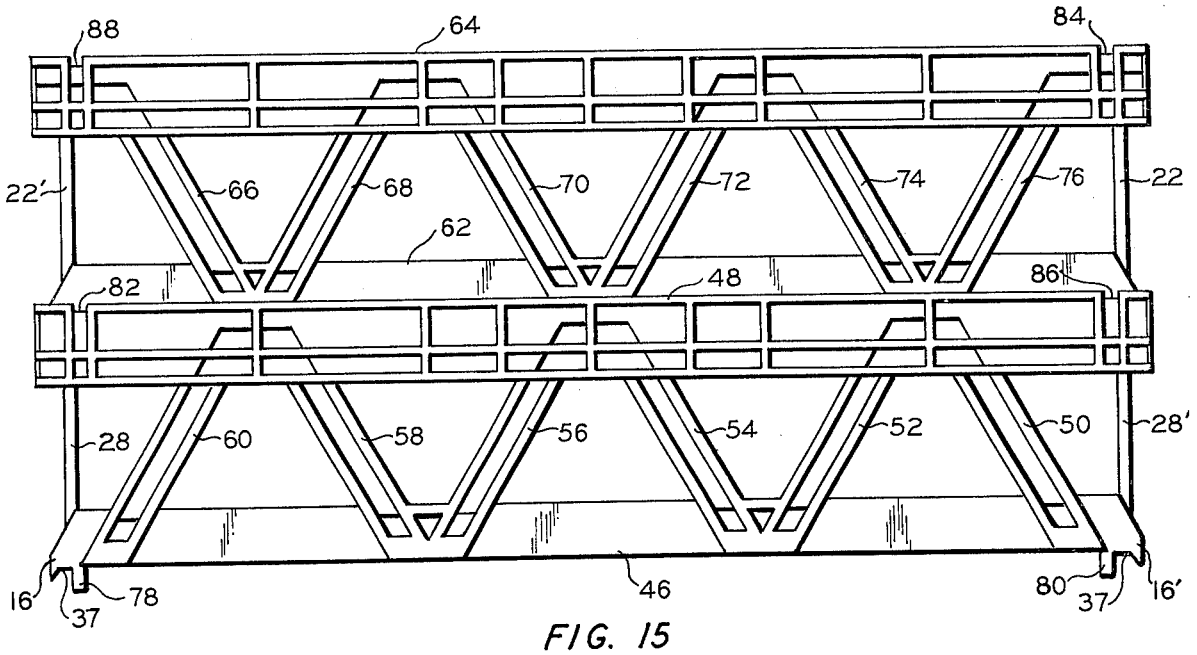

FIG. 15 is a side elevation view showing two of the containers of FIG. 2 in stacked relationship.

Figure 16:
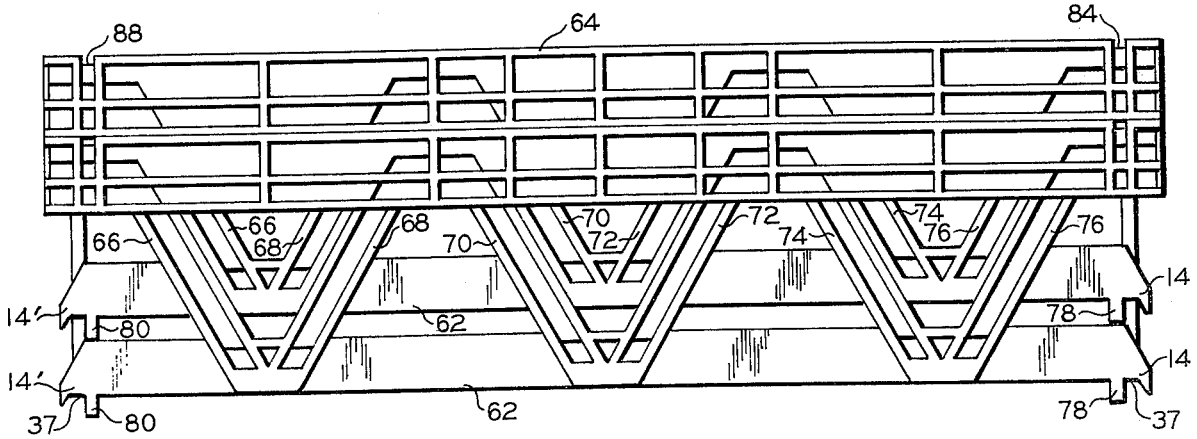

FIG. 16 is a side elevation view showing two of the containers of FIG. 2 in nested relationship.

Referring now to the drawings, wherein like reference numerals are employed to denote like elements, the invention will be more fully explained. In FIGS. 1 to 10, the container there illustrated comprises, in one embodiment, a generally rectangular and horizontally disposed bottom. Said bottom will preferably comprise a suitable gridwork, here denoted generally by the reference numeral 10. Said bottom can comprise any other suitable bottom means such as a planar sheet, a perforated planar sheet, etc.

Preferably, a first border flange 12 extends along a first side of said bottom. A first guide means preferably projects outwardly from said first border flange 12. Said first guide means can comprise a plurality of spaced apart guide lugs which project outwardly from said first border flange. As here illustrated, said first guide means comprises a first guide lug 14 located at least adjacent, but preferably at one end of said first border flange 12, and preferably a second guide lug 16 located at least adjacent, but preferably at, the other end of said first border flange 12. Preferably, a second border flange 18 extends along a second side of said bottom, and a second guide means preferably projects outwardly from said second border flange. As here illustrated, said second guide means comprises first and second guide lugs 14' and 16' projecting from said second border flange in like locations corresponding to the locations of said guide lugs 14 and 16 which project from said first border flange 12.

A first guide rail 20, provided with clearway means A and B therein to accommodate said first guide means during nesting operations, or said second guide means during stacking operations, is disposed generally vertically above and preferably extends substantially the length of said first side of said bottom and comprises a portion of a first wall structure of said container. Said first wall structure further comprises a plurality of spaced apart inclined bars 22, 24, 26, and 28 which extend upwardly between said first side of said bottom and said first guide rail 20. When a border flange 12 is provided on said first side of said bottom, the lower end portions of said inclined bars are secured to the outer surface of said border flange.

A second guide rail 30, provided with clearway means therein (like said clearway means A and B) to accommodate said guide means similarly as described above, is disposed generally vertically above and preferably extends substantially the length of said second side of said bottom and comprises a portion of a second wall structure of the container. Said first guide rail 20 and said second guide rail 30 are adapted to coact with said first and second guide means, respectively, during pre-nesting operations; and to coact with said second and first guide means, respectively, during pre-stacking operations. Said second wall structure further comprises a plurality of inclined bars 22', 24', 26', and 28', preferably located, arranged, and inclined in the same manner and direction as said inclined bars in said first wall structure of the container, which extend upwardly between the second side of said bottom and said second rail 30. When a second border flange 18 is provided along the second side of said bottom, the lower end portions of said inclined bars 22', 24', 26', and 28' are secured to the outer surface of said second border flange. Preferably, said first and second border flanges 12 and 18 each extend generally vertically above and below the plane of said bottom 10.

Preferably, a first upper rim 32 is disposed generally vertically above and has a length which is preferably slightly greater than the length of said first side of said bottom. When said first upper rim is provided, said first guide rail 20 is secured to the inner surface of said first upper rim, and the upper end portions of said inclined bars 22, 24, 26, and 28 are secured to the inner surface of said first guide rail 20. Likewise, a second upper rim 34 is preferably disposed generally vertically above and has a length which is preferably slightly greater than the length of said second side of said bottom. When said second upper rim is provided, said second guide rail 30 is secured to the inner surface of said second upper rim 34, and the upper end portions of said inclined bars 22', 24', 26', and 28' are secured to the inner surface of said second guide rail 30.

As here illustrated, said inclined bar members in each of said first and second walls preferably comprise two pairs of bars, with one pair providing a truncated V-form and the other pair providing an inverted truncated V-form. Preferably, when a said pair of bar members forms an inverted truncated V-form, the tops of the adjacent bar members therein are connected by means of a connecting member 40 for increased strength and to increase the length of the stacking saddles on the tops of said bar members. See FIG. 2. Similarly, the tops of the other inclined bar members in said first and second wall structures are provided with extensions 42 on one side thereof. See FIG. 2.

Preferably, the bottom of each of said bar members 22, 24, 26, and 28 in said first wall structure comprises a stacking foot in a first plurality of stacking feet, and the bottom of each of said bar members 22', 24', 26', and 28' in said second wall structure comprises a stacking foot in a second plurality of stacking feet. However, it is within the scope of the invention for said stacking feet to be disposed at other appropriately spaced apart locations along the first and second sides of said bottom, e.g., along said first and second border flanges 12 and 18. Similarly, it is preferred that the top of each of said bar members in said first and second wall structures comprise a stacking saddle in first and second pluralities of stacking saddles, respectively. However, it is within the scope of the invention for said stacking saddles to be disposed at other appropriately spaced apart locations along the inner surfaces of said first and second guide rails 20 and 30.

The bottoms and the tops of said bar members which comprise said stacking feet and said stacking saddles, respectively, can be essentially flat surfaces. However, it is preferred that the bottoms of said bar members be provided with an upwardly extending and downwardly open recess 36 therein. Preferably, said recess 36 can be formed in one side of the bottoms of said bar members with a said border flange forming one side of said recess. See FIGS. 3, 6, 7, and 8. Thus, in the preferred embodiments of the invention each said stacking foot in said plurality of stacking feet comprises a recess in the bottom of one of said bar members. Similarly, it is preferred that the tops of each of said bar members be provided with an elevated crown 38 having a shape generally corresponding to the shape of said recesses 36 in the bottoms of said bar members. Preferably, said elevated crown 38 can be formed on one side of the tops of said bar members, e.g., the side in which said recess 36 is formed. See FIGS. 6, 7, and 8. Thus, in the preferred embodiments of the invention each said stacking saddle in said pluralities of stacking saddles comprises an elevated crown formed on top of one of said bar members.

Referring again to said first and second guide rails 20 and 30, it is preferred that the top of each of said guide rails be provided with an elevated crown 39 formed on one side thereof, similarly as described above for the tops of said bar members. See FIGS. 2 and 6. Referring again to said guide lugs 14, 16, 14', and 16', it is preferred that the bottom of each of said guide lugs be provided with an upwardly extending and downwardly open recess 37, similar to and formed similarly as described above for said stacking feet. See FIGS. 2, 4, 5, and 6. Preferably, said recess 37 has a shape generally corresponding to the shape of said crowns 39 on the top of said guide rails and is adapted to coact with said crowns 39 in a sliding engagement during pre-stacking and pre-nesting operations. As illustrated, said recess 37 has a span or width great enough to also span the crowns 38 formed on the tops of said bar members when said guide lugs engage said crowns 39 on said guide rails. See FIG. 6.

The above-described container comprising said bottom, said first wall structure, and said second wall structure comprises one embodiment of a nest and stack container in accordance with the invention.

It will be noted that in the above described embodiments of the invention, the location, arrangement, and inclination of the inclined bars of said first wall and the inclined bars of said second wall with respect to each other, the spacing and lateral placement of said clearway means in said first guide rail with respect to the spacing and lateral placement of said first guide means, and the spacing and lateral placement of said clearway means in said second guide rail with respect to the spacing and lateral placement of said second guide means are such that a said container will nest within a like oriented container of like construction. Similarly, said first plurality and said second plurality of stacking feet, and said first plurality and said second plurality of stacking saddles are adapted to support an upper said container in stacked relationship upon a lower container of like construction when said upper container is turned with respect to said lower container so as to align said first and second walls thereof with the second and first walls, respectively, of the lower container, with said first stacking feet registering with said second stacking saddles and said second stacking feet registering with said first stacking saddles.

In another embodiment of the invention, the container can further comprise a third wall structure positioned between and generally perpendicular to said first and second wall structures. Said third wall structure preferably comprises a third border flange 46 extending along a third side of the bottom of the container with the ends thereof connected to adjacent ends of said first border flange 12 and said second border flange 18. Preferably, a third upper rim 48 is disposed generally vertically above and has a length slightly greater than the length of said third side of the bottom of the container. Said upper rim 48 is connected at its ends to adjacent ends of said first upper rim 32 and said second upper rim 34. A plurality of inclined bars 50, 52, 54, 56, 58, and 60 extend upwardly between said third side of the bottom and said third upper rim 48. When said third border flange 46 is provided, the lower ends of said inclined bars are secured to the outer surface thereof. As illustrated in FIG. 2, the inclined bars in said third wall preferably comprise three pairs of bars 50–52, 54–56, and 58–60, with each said pair forming an inverted truncated V-form. The tops of the bar members forming said inverted truncated V-forms are connected by means of a connecting member 40, as in the above-described first and second wall structures, for increased strength and to increase the length of the stacking saddles on the tops of the bar members. Said last mentioned stacking saddles are preferably formed in the same manner as the stacking saddles on the tops of the bar members in the above-described first and second wall structures, i.e., by providing elevated crowns 38 on the tops of the bar members and their connecting members 40. However, if desired, the tops of said bar members can be flat. The bottom of each of the bar members in said third wall structure comprises a stacking foot as in the above described first and second wall structures. When the bottoms of oppositely inclined bars are closely adjacent they are preferably merged to form a truncated V-form. See, for example, bar members 56 and 58, and 52 and 54, in FIG. 5.

Said last-described embodiment of the invention provides a three-walled container wherein one side of the container is open. Said open side is convenient for reaching into a loaded container in a stack of containers to remove articles therefrom without having to remove the loaded container from the stack of containers.

In the present most preferred embodiment of the invention, there is provided a fourth wall structure which is disposed opposite said third wall structure and which is positioned between and generally perpendicular to said first and second wall structures. Said fourth wall structure preferably comprises a fourth border flange 62 which extends along a fourth side of the bottom of the container with the ends thereof being connected to adjacent ends of said first and second border flanges 12 and 18. Preferably, a fourth upper rim 64 is disposed generally vertically above and has a length slightly greater than the length of said fourth side of said bottom. The ends of said fourth upper rim 64 are connected to adjacent ends of said first and second upper rims 32 and 34. A plurality of inclined bar members 66, 68, 70, 72, 74, and 76 extend upwardly between said fourth border flange 62 and said fourth upper rim 64. When said fourth border flange 62 is provided, the lower ends of said inclined bar members are secured to the outer surface thereof. Preferably, the inclined bar members in said fourth wall are inclined oppositely from the inclined bars in said third wall, as illustrated in FIGS. 2 and 4. Said inclined bar members preferably comprise three pairs of bars 66–68, 70–72, and 74–76, with each said pair forming a truncated V-form wherein the closely adjacent bottoms of oppositely inclined bar members are merged. The tops of end bar members 66 and 76 are preferably provided with horizontally extending extensions 42, similarly as for bar member 22 in said first wall structure. The tops of bar members 68 and 70, and the tops of bar members 72 and 74 are preferably connected by connecting members 40 as described above. The tops of all of said bar members are provided with stacking saddles as described above. The bottoms of said bar members are provided with stacking feet as described above.

In the four walled container of the invention, said first border flange 12 preferably extends below the plane of the bottom of the container to provide a first guide foot 78 at one end of the container. Similarly, said second border flange 18 preferably extends below the plane of the bottom of the container to provide a second guide foot 80 at the other end of the container. Preferably, said third and fourth upper rims 48 and 64 are each provided with first guide recesses 82 and 84, respectively, located in the upper edge thereof vertically above said first guide foot 78 on first border flange 12. Each of said upper rims 48 and 64 is also provided with second guide recesses 86 and 88, respectively, located in the upper edges thereof vertically above said second guide foot 80 on the bottom of second border flange 18. Said first guide recesses 82 and 84 are adapted to receive said first guide foot 78, and said second guide recesses 86 and 88 are adapted to receive said second guide foot 80 while a like container is being moved into nested or stacked relationship with another like container, as described further hereinafter.

Referring now to FIG. 11, the container of the invention there illustrated is like the containers illustrated in FIGS. 1–10, except that an inwardly extending ledge 44 is provided on each of the bar members conprising the wall structures of containers intermediate the ends of said bar members. Preferably, said ledge will be provided at about the midpoint of said bar members. The bar members in the two wall structures of the above-described two-wall containers, the bar members in the three wall structures of the three-wall containers, and the bar members in the four wall structures of the four-wall containers can all be provided with ledges 44. However, it is within the scope of the invention to provide ledges 44 on the bar members in only two opposite wall structures. Said ledges 44 provide means for "partial-nesting", e.g., "half-nesting" of the containers of the invention, as will be understood by those skilled in the art in view of this disclosure.

Referring now to FIGS. 12, 13, and 14, there are illustrated other containers of the invention wherein the bar members provided in the wall structures of the container are disposed essentially vertical, e.g., extend upwardly between a lower border flange and an upper guide rail or an upper rim. Otherwise, said containers of FIGS. 12, 13, and 14 are like the above-discussed containers illustrated in FIGS. 1–11.

For example: said vertically extending bar members can be provided with inwardly extending ledges intermediate the ends thereof as shown in FIG. 14, preferably at about the midpoint thereof; the bottom of each of said vertically exending bar members comprises a stacking foot, and can be essentially flat or have an upwardly extending and downwardly open recess provided therein, preferably in one side thereof; the top of each of said vertically extending bar members comprises a stacking saddle, and can be essentially flat or have an elevated crown provided thereon, preferably on one side thereof; and said recesses and said crowns, when provided, have generally corresponding shapes and are adapted to coact in the stacking of said containers as described further hereinafter.

Figure 3:
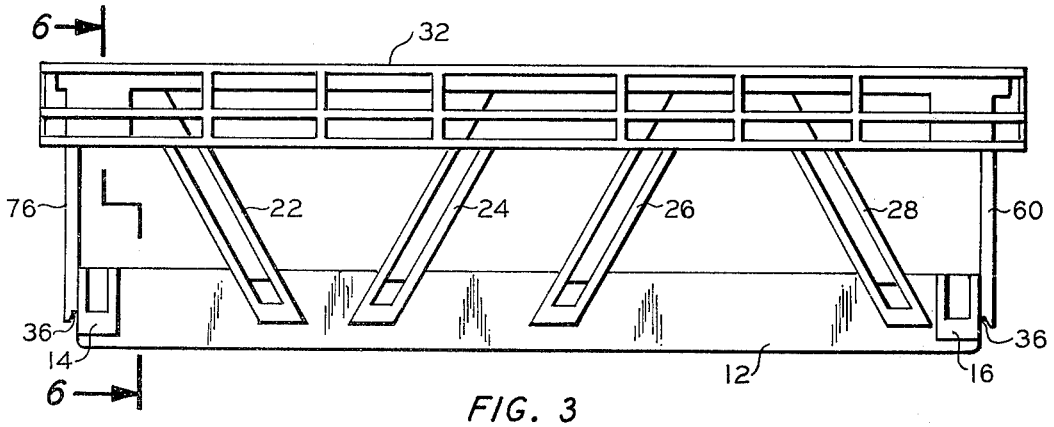
FIG. 3 is an end elevation view of the right-hand end of the container illustrated in FIGS. 1 and 2. It will be understood that the left-hand end of said container is a mirror image of the right-hand end.

Referring to FIG. 12, the end view there shown corresponds generally to the end view shown in FIG. 3. Thus, the vertical bar members 90, 92, 94, and 96 can be said to correspond generally to the inclined bar members 22, 24, 26, and 28 in FIG. 3. In order to reduce the number of drawings, the view in said FIG. 12 is taken looking through the container so as to show the bar members 98, 100, 102, 104, and 106 in the distant opposite end wall structure of the container. It will be noted that in the container illustrated in FIG. 12 the near end wall structure comprises four vertical bar members, whereas the distant opposite wall structure comprises five vertical bar members. It should be further noted that each bar member in said distant opposite end wall structure is positioned opposite a space which is between two bar members in said near end wall structure.

Referring to FIG. 13, the side view there shown corresponds generally to the side view shown in FIG. 4. Thus, the vertical bar members 108, 110, 112, 114, and 116 can be said to correspond generally to the inclined bar members 66, 68, 70, 72, 74, and 76 in FIG. 4. Similarly as in FIG. 12, the view in FIG. 13 is taken looking through the container so as to show the bar members 118, 120, 122, and 124 in the distant opposite sidewall structure of the container. It will be noted that in the container illustrated in FIG. 13 the near sidewall structure comprises five vertical members, whereas the distant opposite side wall structure comprises four vertical bar members. It should be further noted that each bar member in said distant opposite sidewall structure is positioned opposite a space which is between two bar members in said near sidewall structure.

The number and positioning of the vertical bar members in the containers of FIGS. 12, 13, and 14 is not critical. All that is required is that the bar members and spaces of a first wall must be arranged with respect to the bar members and spaces of an opposed second wall so that the columns of said first wall will be received into the spaces of said second wall when an upper container is rotated for nesting.

In all the containers of the invention, it is preferred that the bottom border flanges 12, 18, 46, and 62 extend above the plane of the container bottom a small finite distance.

The nesting of the containers of the invention having inclined bar members in the walls thereof is illustrated in FIG. 16. As there shown, in nesting, the corresponding wall structure of a like oriented upper container fits directly downward into the corresponding wall structure of a like lower container. For example, the truncated V-form of inclined bars 66 and 68 of an upper container fit into the like truncated V-form of the inclined bars 66 and 68 of the lower container with the like inclined bars of said V-forms paralleling each other.

The guide lugs 14 and 16 are accommodated by and passed through clearways B and A in guide rail 20, respectively. See FIG. 2. Guide lugs 14' and 16' pass through similar passageways in guide rail 30. During nesting, the feet 78 and 80 on the bottom of border flanges 12 and 18 of an upper container abut and rest on top of border flanges 12 and 18 of a lower container.

The nesting of the containers of the invention having essentially vertical bar members in the wall structures, e.g., those containers illustrated in FIGS. 12, 13, and 14 differs from that of the containers having inclined vertical bar members in the wall structures, e.g., those containers illustrated in FIGS. 1–11. Said containers of FIGS. 1–11 will nest within a like oriented container whereas the containers of FIGS. 12, 13, and 14 must be rotated 180° in order to nest. For example, referring to FIGS. 12 and 13, an upper container must be rotated 180° with respect to a like lower container so that the bar members of the opposite distant wall structure will be received within spaces between the bar members of the near wall structure when the containers are nested.

The stacking of the containers of the invention having inclined bar members in the walls thereof is illustrated in FIG. 15. The stacking operation is initiated by turning an upper container 180° with respect to a like lower container. If the lower container is at a low level, e.g., on the floor or on a low table, the upper container can be placed directly onto the lower container. In stacked position, the stacking feet on the bottoms of the bar members in a first wall of the upper container register with and are supported by the stacking saddles on the tops of the bar members in a normally opposite second wall. For example, referring to FIGS. 2 and 15, the feet on the bottoms of bar members 70 and 72 register with and are supported by the saddles on the tops of the bar members 56 and 54. Preferably, said stacking feet and stacking saddles are provided with recesses 36 and crowns 38, respectively, as described above. In the four-wall containers of the invention, the bottom periphery of the upper container is positioned well below the periphery of the top edge of the upper rims 32, 34, 48, and 54 of the lower container, thus locking the upper container with respect to lateral movement in any direction.

The stacking of the containers of the invention having essentially vertical bar members in the wall structures, e.g., those illustrated in FIGS. 12, 13, and 14, differs from the stacking of the containers having inclined bar members in the wall structure, e.g., those illustrated in FIGS. 1–11. Said containers having inclined bar members in the wall structures thereof are stacked by rotating an upper container 180° with respect to a like lower container. In contrast, like oriented containers having essentially vertical bar members will stack directly on each other. For example, referring to FIGS. 12, 13, and 14, the bottoms of the bar members of an upper container stack directly on top of the bar members of a like oriented lower container of like construction.

As mentioned above, an outstanding feature of the containers of the invention is the blind stacking and blind nesting which the construction of the containers of the invention makes possible. This feature of the invention is of great value when the containers are being stacked at any height at which it is inconvenient to lift the upper container to a position directly above the lower container. In such instances, the stacking operation of the preferred four wall containers can be initiated by placing the feet 78 and 80 (on the bottom of border flanges 12 and 18) of the upper container in register with guide recesses 84 and 88, or guide recesses 82 and 86, of one of the upper rims 48 and 64 of the lower container. The specific register of a specific one of said guide feet 78 and 80 with a specific one of said guide recesses 84 and 88, for example, will depend upon the orientation of the upper container with respect to the lower container, which in turn depends upon the specific construction of said containers and whether it is intended to stack or nest said containers, as discussed herein. The upper container is then moved across the lower container, preferably at a slight tilt so as to bring recesses 37 in the guide lugs 14 and 14', or 16 and 16', in register with crowns 39 of the guide rails 20 and 30, until the bottom periphery of the upper container is within the top periphery of the lower container. Said recesses 37 and crowns 39 thus cooperate in a sliding engagement with said guide recesses 84 and 88 (or 82 and 86) and feet 78 and 80, in guiding the upper container into proper position for stacking or nesting. The just described operation can be considered a "prenesting" or a "pre-stacking" operation. When the upper container is oriented for nesting and the bottom periphery of the upper container is within the top periphery of the lower container, the guide lugs 14 and 14', and 16 and 16', will be accommodated by and pass through the clearways B and A respectively (or A and B depending upon container construction), and the upper container will drop into the lower container in nested relationship. When the upper container is oriented for stacking and the bottom periphery of the upper container is within the top periphery of the lower container, said guide lugs will pass into and be accommodated by said clearways and the upper container will drop into stacked relationship with said lower container. In said stacked relationship the stacking feet on the bottom of the bar members in the walls of the upper container register with and are supported by the stacking saddles on the tops of the bar members in the walls of the lower container. It will be noted that the level of crowns 39 on guide rails 20 and 30 is higher than the level of the crowns 38 on the tops of the bar members. See FIG. 6, for example.

The above-described blind stacking and blind nesting can be readily carried out without visual observation of the guide means and the stacking feet or stacking saddles by an operator because feet 78 and 80 will readily drop into guide recesses 84 and 88 (or 82 and 86) when an upper container is placed on an upper rim 48 or 64 of a lower container. If necessary, said guide recesses can be readily located with said feet by a slight back and forth lateral movement of the upper container. Said blind stacking and blind nesting can also be carried out in the containers of the invention which are provided with only two opposing walls, and which are thus not provided with guide recesses 82, 84, 86, and 88. In such instances it is only necessary that the operator place the recesses 37 in guide lugs 14 and 14' (or 16 and 16') into register with crowns 39 on guide rails 20 and 30 and proceed as described above. This can be readily accomplished because, as pointed out above, the span or width of said recesses 37 is great enough to span both said crowns 39 and the crowns 38 on the tops of the bar members when the latter crowns are provided.

From the above descriptions of the containers of the invention, and the nesting and stacking features thereof, it is clear that: the location, the arrangement, and the directional disposition of the bar members in opposite wall structures with respect to each other, e.g., a first and second wall structure which also respectively comprise first and second guide rails; and the spacing and lateral placement of clearway means provided in said guide rails with respect to the spacing and lateral placement of respective first and second guide means provided on said containers; are such that an upper said container will nest within a like lower container when said upper container is in one of the positions of (a) identical orientation with respect to said lower container, and (b) rotated orientation with respect to said lower container. It is also clear that: first and second pluralities of stacking feet, and first and second pluralities of stacking saddles, provided in said first and second wall structures respectively, are adapted with respect to the relative positions and structures thereof to support an upper said container in stacked relationship on a like lower container when said upper container is in one of the positions of (a) identical orientation with respect to said lower container so as to align the first and second walls of said upper container with the first and second walls respectively of said lower container, with said first stacking feet registering with said first stacking saddles and said second stacking feet registering with said second stacking saddles, and (b) rotated orientation with respect to said lower container so as to align the first and second walls of said upper container with the second and first walls respectively of said lower container, with said first stacking feet registering with said second stacking saddles and said second stacking feet registering with said first stacking saddles, and with said guide means disposed in said clearway means. Thus, all the containers of the invention will nest when an upper container is in one of said positions (a) and (b) with respect to a lower container of like construction, and will stack when said upper container is in the other of said positions (a) and (b) with respect to said lower container.

The containers of the invention can be fabricated in any suitable manner known to the art. Injection molding, for example, is one presently preferred method for fabricating said containers. Said containers can be fabricated from any suitably material. High density polyethylenes are especially desirable materials from which to fabricate said containers. The high density polyethylenes prepared by the methods disclosed and claimed by J. P. Hogan et al. in U.S. Pat. No. 2,825,721, issued Mar. 4, 1958, comprise one group of presently preferred materials. Said containers can also be fabricated from butadiene-styrene copolymers, and other plastic materials. If desired, a reinforcing fibrous material, such as asbestos or glass fibers, can be incorporated in the plastic material. While the various plastics are presently preferred for the manufacture of the containers, it is within the scope of the invention to fabricate said containers from other materials, e.g., lightweight metals such as aluminum, reinforced pulp materials, etc.

As an example, one model of a container fabricated in accordance with the invention had an overall length of about 24 inches, an overall width of about 21 inches, and an overall height of about 6 inches. Guide lugs 14, 14', 16 and 16' had a width of about 1 inch. The inclined bars in the wall of the container were approximately six inches in length. The upper surface of the T bars in the gridwork bottom was approximately one-fourth inch wide. The dimensions of the other elements of the container were generally proportional in size.

Herein and in the claims, the word "rectangular" has been employed generically to include four-side structures which are generally square and four-sided structures wherein one pair of sides is longer than the other pair of sides.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

I claim:

1. A generally rectangular nesting and stacking container comprising:

a generally horizontally disposed bottom; opposed first and second wall structures respectively projecting upwardly from opposed first and second sides of said bottom; with each of said wall structures comprising, in combination:

a pair of spaced apart guide lugs projecting outwardly from a said side of said bottom, one of said lugs being adjacent one end of said side of said bottom and the other lug adjacent the other end of said side;

a guide rail disposed generally vertically above said side of said bottom for receiving and supporting on its upper surface a said guide lug of a like upper container only during pre-nesting and pre-stacking operations;

a plurality of spaced apart inclined bar members extending upwardly between said side of said bottom and the inner surface of said guide rail for supporting said guide rail, and arranged so that, , whereby an upper said container will nest within a like oriented lower said container with the bars of corresponding wall structures paralleling each other but will stack on a reversely oriented lower said container as described hereinafter;

a plurality of stacking saddles provided on the tops of a like plurality of said bar members at an elevation less than that of said upper surface of said guide rail;

a plurality of stacking feet provided on the bottoms of a like plurality of said bar members at an elevation greater than that of said guide lugs for registering in vertical alignment with a said plurality of stacking saddles on a said reversely oriented like lower container in supporting a said upper container on a said lower container in stacking relationship; and clearway means provided in said guide rail in vertical alignment with said guide lugs for permitting passage therethrough of the guide lugs of a like upper container during nesting operations when said stacking feet and said stacking saddles are not in vertical alignment, and for receiving therein the guide lugs of said upper container at the end of stacking operations.

2. A container according to claim 1 wherein:

an upper rim is disposed generally vertically above a said side of said bottom;

said guide rail is secured to the inner surface of said upper rim;

the upper end portions of said bar members are secured to the inner surface of said guide rail;

a border flange extends along a said side of said bottom;

the lower end portions of said bar members are secured to the outer surface of said border flange; and said guide lugs are secured to the outer surface of said border flange.

3. A container according to claim 2 wherein:

each said stacking foot comprises a recess in the bottom of one of said bar members; and each said stacking saddle comprises an elevated crown on the top of one of said bar members, said crowns having a shape generally corresponding to the shape of said recesses in the bottoms of said bar members.

4. A container according to claim 3 wherein:

the top of said guide rail is provided with an elevated crown; and each said guide lug is provided with a recess in the bottom thereof which has a shape generally corresponding to the shape of said crown on said guide rail and is adapted to coact with said crown in a sliding engagement during said pre-nesting and pre-stacking operations.

5. A container according to claim 4 wherein said bar members in each of said first and second wall structures comprise two pairs of bars, with one pair providing a truncated V-form and the other pair providing an inverted truncated V-form.

6. A container according to claim 5 wherein an inwardly extending ledge is provided on each of said bar members intermediate the ends thereof.

7. A container according to claim 6 wherein said ledge is provided at about the mid-point of each of said bar members.

8. A container according to claim 5 wherein there are also provided opposing third and fourth wall structures, each positioned between and generally perpendicular to said first and second wall structures, and wherein said third and fourth wall structures each comprises, respectively:

a third border flange and a fourth border flange, extending respectively along a third side and a fourth side of said bottom with the ends thereof connected to adjacent ends of the border flanges in said first and second wall structures;

a third upper rim and a fourth upper rim respectively disposed generally vertically above said third side and said fourth side of said bottom, and connected at the ends thereof to adjacent ends of the upper rims in said first and second wall structures; and a plurality of spaced apart inclined bar members extending upwardly between the outer surface of said border flange and the inner surface of said upper rim in each of said third and fourth wall structures;

with the bar members in said third wall structure comprising three pairs of bars, with each pair of bars providing a truncated V-form;

and with the bar members in said fourth wall structure being inclined oppositely from corresponding bar members in said third wall structure and also comprising three pairs of bars, with each pair of bars providing an inverted truncated V-form, whereby an upper said container will nest within an identically oriented lower said container and will stack on a reversely oriented lower container.

9. A container according to claim 8 wherein:

the bottom of each of said bar members in said third and fourth wall structures comprises a stacking foot; and the top of each of said bar members in said third and fourth wall structures comprises a stacking saddle.

10. A container according to claim 9 wherein:

each said stacking foot comprises a recess in the bottom of one of said bar members; and each said stacking saddle comprises an elevated crown on the top of one of said bar members, with each said crown having a shape corresponding generally to the shape of said recesses in the bottoms of said bar members.

11. A container according to claim 10 wherein an inwardly extending ledge is provided on each of said bar members, intermediate the ends thereof, in said third and fourth wall structures.

12. A container according to claim 11 wherein said ledge is provided at about the mid-point of each of said bar members.

13. A container according to claim 8 wherein:

said first and second border flanges of said first and second wall structures, respectively, each extend vertically above and below the horizontal plane of said bottom; and said third and fourth upper rims of said third and fourth wall structures, respectively, are each provided with guide recesses therein at positions in vertical alignment above said first and second border flanges and are adapted to receive therein and coact with the downwardly extending portions of said first and second border flanges during pre-nesting and pre-stacking operations.

14. A generally rectangular nesting and stacking container comprising:

a generally horizontally disposed bottom; opposed first and second wall structures respectively projecting upwardly from opposed first and second sides of said bottom; with each of said wall structures comprising, in combination:

a pair of spaced apart guide lugs projecting outwardly from a said side of said bottom, one of said lugs being adjacent one end of said side of said bottom and the other lug adjacent the other end of said side;

a guide rail disposed generally vertically above said side of said bottom for receiving and supporting on its upper surface a said guide lug of a like upper container only during pre-nesting and pre-stacking operations;

a plurality of spaced apart bar members extending vertically between said side of said bottom and the inner surface of said guide rail for supporting said guide rail, with the bar members in one of said opposed wall structures being located opposite a space not occupied by a bar member in the other of said wall structures, whereby an upper said container will nest within a reversely oriented lower said container with the bars in one said wall structure occupying open spaces in the opposing wall structure but will stack on a like oriented lower said container as described hereinafter;

a plurality of stacking saddles provided on the tops of a like plurality of said bar members at an elevation less than that of said upper surface of said guide rail;

a plurality of stacking feet provided on the bottoms of a like plurality of said bar members at an elevation greater than that of said guide lugs for registering in vertical alignment with a said plurality of stacking saddles on a said like oriented lower container in supporting a said upper container on a said lower container in stacking relationship; and clearway means provided in said guide rail in vertical alignment with said guide lugs for permitting passage therethrough of the guide lugs of a like upper container during nesting operations when said stacking feet and said stacking saddles are not in vertical alignment, and for receiving therein the guide lugs of said upper container at the end of stacking operations.

15. A container according to claim 14 wherein:

an upper rim is disposed generally vertically above a said side of said bottom;

said guide rail is secured to the inner surface of said upper rim;

the upper end portions of said bar members are secured to the inner surface of said guide rail;

a border flange extends along a said side of said bottom;

the lower end portions of said bar members are secured to the outer surface of said border flange; and said guide lugs are secured to the outer surface of said border flange.

16. A container according to claim 15 wherein:

each said stacking foot comprises a recess in the bottom of one of said bar members; and each said stacking saddle comprises an elevated crown on the top of one of said bar members, said crowns having a shape generally corresponding to the shape of said recesses in the bottoms of said bar members.

17. A container according to claim 16 wherein:

the top of said guide rail is provided with an elevated crown; and each said guide lug is provided with a recess in the bottom thereof which has a shape generally corresponding to the shape of said crown on said guide rail and is adapted to coact with said crown in a sliding engagement during said pre-nesting and pre-stacking operations.

18. A container according to claim 17 wherein an inwardly extending ledge is provided on each of said bar members intermediate the ends thereof.

19. A container according to claim 18 wherein said ledge is provided at about the midpoint of each of said bar members.

20. A container according to claim 17 wherein there are also provided opposing third and fourth wall structures, each positioned between and generally perpendicular to said first and second wall structures, and wherein said third and fourth wall structures each comprises, respectively:

a third border flange and a fourth border flange, extending respectively along a third side and a fourth side of said bottom with the ends thereof connected to adjacent ends of the border flanges in said first and second wall structures;

a third upper rim and a fourth upper rim respectively disposed generally vertically above said third side and said fourth side of said bottom, and connected at the ends thereof to adjacent ends of the upper rims in said first and second wall structures; and a plurality of spaced apart bar members extending vertically between the outer surface of said border flange and the inner surface of said upper rim in each of said third and fourth wall structures;

with the bar members in said third wall structure being located opposite a space not occupied by a bar member in said fourth wall structure, whereby an upper said container will nest within a reversely oriented lower said container but will stack on a like oriented lower container.

21. A container according to claim 20 wherein:

the bottom of each of said bar members in said third and fourth wall structures comprises a stacking foot; and the top of each of said bar members in said third and fourth wall structures comprises a stacking saddle.

22. A container according to claim 21 wherein:

each said stacking foot comprises a recess in the bottom of one of said bar members; and each said stacking saddle comprises an elevated crown on the top of one of said bar members, with each said crown having a shape corresponding generally to the shape of said recesses in the bottoms of said bar members.

23. A container according to claim 22 wherein an inwardly extending ledge is provided on each of said bar members, intermediate the ends thereof, in said third and fourth wall structures.

24. A container according to claim 23 wherein said ledge is provided at about the midpoint of each of said bar members.

25. A container according to claim 24 wherein:

said first and second border flanges of said first and second wall structures, respectively, each extend vertically above and below the horizontal plane of said bottom; and said third and fourth upper rims of said third and fourth wall structures, respectively, are each provided with guide recesses therein at positions in vertical alignment above said first and second border flanges and are adapted to receive therein and coact with the downwardly extending portions of said first and second border flanges during pre-nesting and pre-stacking operations.

* * * * *